United States Patent [19]

Sansone et al.

[11] 4,246,856

[45] Jan. 27, 1981

[54] PRESSER FOOT LIFT OPERABLE INDEPENDENTLY BY MANUAL OR POWER DEVICES

[75] Inventors: Eugene A. Sansone, Belle Meade; Edward A. Sukovich, Colonia, both of N.J.

[73] Assignee: The Singer Company, Stamford, Conn.

[21] Appl. No.: 57,241

[22] Filed: Jul. 13, 1979

[51] Int. Cl.[3] ..... D05B 29/02

[52] U.S. Cl. ..... 112/239

[58] Field of Search ..... 112/237, 238, 239, 311

[56] References Cited

U.S. PATENT DOCUMENTS

| | | | |
|---|---|---|---|
| 1,147,139 | 7/1915 | Briggs | 112/239 |
| 1,383,438 | 7/1921 | Stein | 112/239 |
| 1,679,357 | 8/1928 | Hansen | 112/239 |
| 1,761,899 | 6/1930 | Wenzel | 112/239 |
| 2,009,194 | 7/1935 | Hleb | 112/239 |
| 3,347,194 | 10/1967 | Hale et al. | 112/237 |
| 3,353,511 | 11/1967 | Marino | 112/237 |

FOREIGN PATENT DOCUMENTS

| | | | |
|---|---|---|---|
| 474966 | 3/1915 | France | 112/239 |

*Primary Examiner*—Werner H. Schroeder
*Assistant Examiner*—Andrew M. Falik
*Attorney, Agent, or Firm*—Elliot A. Lackenbach; Robert E. Smith; Edward L. Bell

[57] ABSTRACT

A sewing machine is described having a presser foot lifting arrangement actuated by a presser lifting rock shaft in the sewing machine arm and both a power operated presser lifting device such as a pneumatic cylinder, electric solenoid, or other actuator as well as an operator controlled presser lifter actuator such as a knee shift or the like wherein there is provided linkage means connecting the presser lifting rock shaft in the sewing machine arm with both the operator influenced and power driven actuator. The linkage means is formed with a pair of parallel lost motion slots each embracing a crank pin associated with a respective one of the actuators so that both actuators are connected for independent operation without influence on each other.

6 Claims, 3 Drawing Figures

PRESSER FOOT LIFT OPERABLE INDEPENDENTLY BY MANUAL OR POWER DEVICES

FIELD OF THE INVENTION

This invention relates to sewing machines and, more particularly, to a presser foot lift operable independently by manual or power operated means.

BACKGROUND OF THE INVENTION

In industrial sewing machines, that is, sewing machines adapted especially for commerical fabrication of sewn articles of commerce as opposed to the class of sewing machines generally referred to as home sewing machines, the amount of sewing achieved per day is relatively high. Accordingly, operator fatigue is a much more significant factor than in home or domestic sewing machines. Moreover, the rate of production is of more economic significance such as to justify various power assisted operations of portions of the machine that would not be economically justified in a home or domestic machine. For example, many industrial sewing machines are provided with power assisted presser foot lifts and the power assist may be provided, for example, by means of an electrically operated solenoid or by means of a pneumatic cylinder. The power actuating means can be under the operators direct control, as by a treadle, knee or hand control or may be automatic in nature whereby a specific set of stitches is to be repetitively performed by the machine and the presser foot then automatically lifted at the end of the sewing cycle as in a cam controlled machine, an electronic pattern machine, or the like.

Even when the power actuator means for lifting the presser foot is present to relieve operator fatigue, it is sometimes desirable to provide a manual override thereof for manual actuation by the operator and under certain circumstances it is especially desirable that such a manual override provide fine control of the presser foot rise to less than the amount of lift that would be appropriate at the end of a seam or stitching operation. For example, it is sometimes desirable to feather the elevation of the presser foot for sewing over especially heavy felled or lapped seams or for providing sharp curvature seams.

There have been previously disclosed presser lifting arrangements with both manual and power driven actuators utilizing a single lost motion connection so that the operation of the manual actuator does not effect movement back into the power actuator mechanism. In such previously known arrangements, however, operation of the power actuator will effect movement of the manual actuating mechanism which could be fatiguing or annoying to the operator.

OBJECTS OF THE INVENTION

Accordingly, it is a primary object of the present invention to provide novel and improved presser lifting arrangements having both manual direct operator override control as well as power actuated control having complete independence of operation as between the manual and power actuators of a presser lifter mechanism.

Another primary object of the present invention, in addition to the foregoing objects, is to provide such complete independence of operation as between a manual and a power actuator of a presser lifting arrangement through having lost motion connects between each of the manual lifting and power actuated lifting means and the presser lifter mechanism.

It is yet another primary object of the present invention, in addition to each of the foregoing objects, to provide such complete independence of operation through the provision of a connecting link between the presser lifting rock shaft in a sewing machine arm with a pair of parallel lost motion slots each embracing a crank pin of respectively associated manual and power actuators.

It is yet still another primary object of the present invention, in addition to each of the foregoing objects, to provide in a mechanism of the class described a pair of bell cranks for actuating the respective ones of the crank pins within the respective parallel lost motion slots.

Another and yet still further primary object of the present invention, in addition to each of the foregoing objects, is the provision of such a presser foot lifting arrangement which is economical to manufacture yet durable and efficient in use.

Still another and yet further primary object of the present invention, in addition to each of the foregoing objects, is the provision of novel and improved methods of presser foot lifting for a sewing machine enabling power actuated presser foot lifting or manual operator presser foot lifting with complete independent operation therebetween without influence on each other.

The invention resides in the combination, construction, arrangement and disposition of various component parts and elements incorporated in improved presser foot lift mechanisms constructed and operated in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention a sewing machine having a presser foot lifting arrangement actuated by a presser lifting rock shaft in the sewing machine arm and both a power operated presser lifting actuator such as a pneumatic cylinder, electric solenoid, or other linear or rotary actuator as well as an operator controlled presser lifter actuator such as a knee shift or the like wherein there is provided linkage means connecting the presser lifting rock shaft in the sewing machine arm with both the operator influenced and power driven actuator linkages being formed with a pair of parallel lost motion slots each embracing a crank pin associated with a respective one of the actuators so that both actuators are connected for independent operation without influence on each other.

DESCRIPTION OF THE DRAWING

Further features and objects of the present invention will appear from the following description and appended claims when read in conjunction with the accompanying drawing wherein:

DETAILED DESCRIPTION OF THE INVENTION

Figure 1:
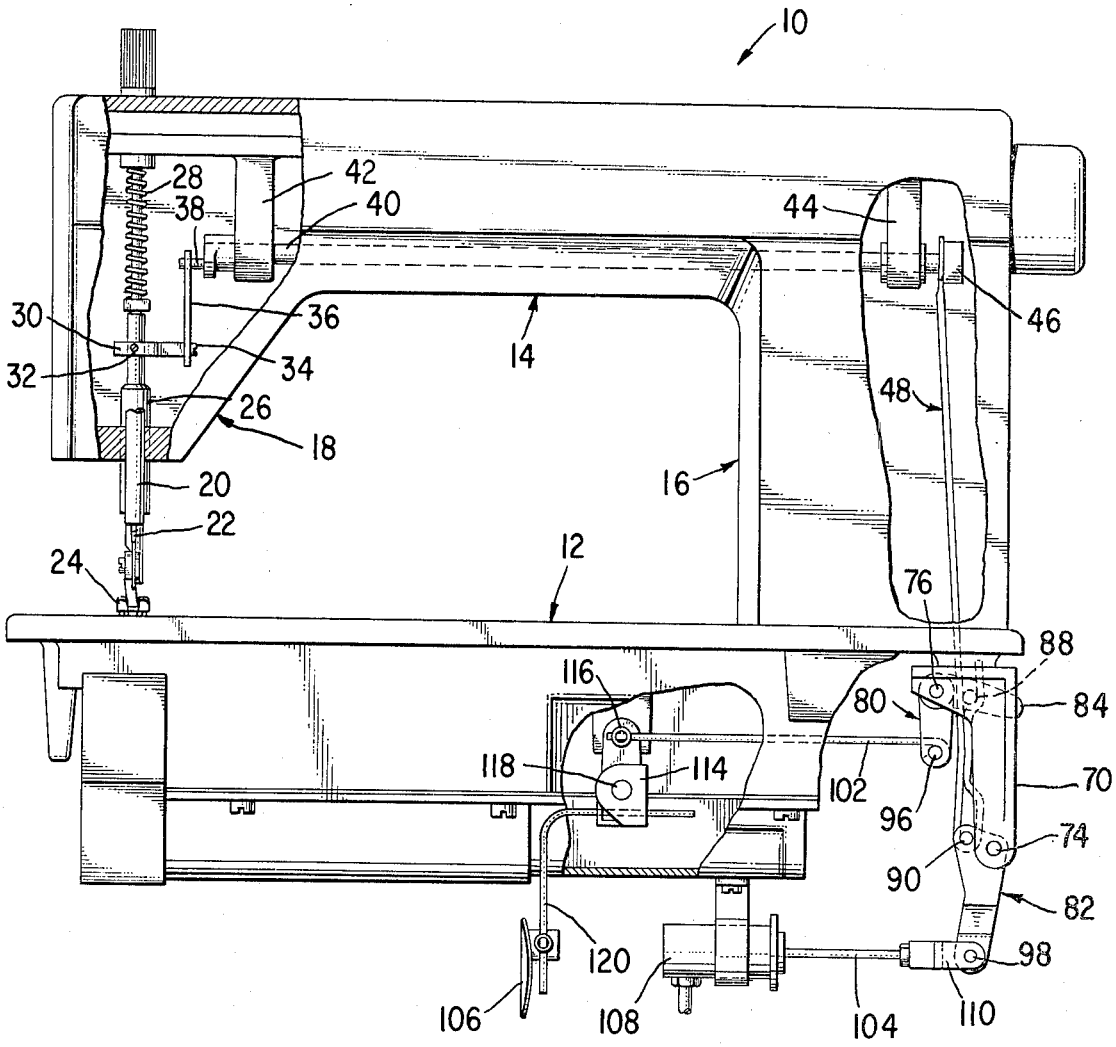
FIG. 1 is an elevational view of an industrial sewing machine provided with an operator influenced presser lifter which has a knee shifter or the like and a power operated presser lifting device such as an air cylinder together with a linkage arrangement in accordance with the present invention whereby the power operated presser lifting device and the operator influenced presser lifter device are connected for independent operation without influence on each other.

Referring now to the drawing, there is shown and illustrated an industrial sewing machine designated generally by the reference character 10 such as the Singer Centurion industrial sewing machine Model 121D200A. Details of the machine operation and general overall construction do not form a part of the present invention and, accordingly, the same construction will not be herein described except to point out that the machine in general comprises a bed portion 12, a bracket arm portion 14 and a standard portion 16 supporting the bracket arm 14 to extend above the bed portion 12. The head end portion 18 of the bracket arm portion 14 carries a reciprocating needle bar 20 which in turn carries an eye pointed needle 22. Means, not shown, are provided for reciprocating the needle bar 20 and eye pointed needle 22 so that it is sequentially dipped into and withdrawn from the bed portion 12 to carry a needle thread into and out of the bed portion 12. The bed portion 12, in turn, is provided with some mechanism, generally timed to the reciprocation of the eye pointed needle 22. The mechanism within the bed portion 12 engages the needle thread in a stitch forming process which may be either a chain stitch or a lock stitch depending upon the mechanism incorporated.

Further necessary to the effective sewing operation of the machine 10 is a presser foot 24 which holds the material being sewn against the needle plate of the bed portion 12 so that as the needle reciprocates for the stitch forming process, friction of the needle and thread will not unduly lift and then drop the material being sewn since it is necessary that the material being sewn remain generally stationary on the needle plate of the bed portion 12 while the needle passes through it, especially as the needle starts its rise.

The presser foot 24 is carried by a presser bar 26 which is also reciprocally mounted within the head end portion 18 of the bracket arm 14 and biased downwardly towards the machine bed portion 12, as by a pressure spring 28. At the beginning and end of a line of stitches it is generally desireable to raise the presser foot 24 so as to permit the material being sewn to be moved rapidly away from the stitch location so that a new piece or set of materials can be brought into position and introduced underneath the needle for the start of a new seam at which time the presser foot is then lowered to permit the new seam to be sewn. At other times it is desired to raise the presser foot 24, such as to change the needle, rethread the machine, or the like. Also, it is sometimes desireable to not fully raise the presser foot 24 but to raise it only partially or to merely relieve some or all of the spring tension thereon, as for turning corners. Means for lifting the presser foot are therefore provided in the machine 10 which may comprise, for example, a presser bar lifter cam 30 attached to the presser bar 26, as by a screw 32 and connected to a link 36 as by a screw 34. The link 36 in turn is connected with a crank 38 carried by a rock shaft 40 journalled within the bracket arm 14, as by means of bosses 42 and 44. Hence, upon rotation of the rock shaft 40 the crank 38 will lift the link 36, in turn lifting the presser bar 26 and presser foot 24. In order to enable the rock shaft 40 to be rocked or rotated to raise the presser foot 24, the other end of the rock shaft 40 is provided with a further crank 46 extending towards the rear of the machine 10 and a connecting link 48 is pivotally connected to the crank 46 so that when the connecting link 48 is pulled downwardly, the crank 38 will move upwardly and the presser foot 24 will be raised.

The lower end of the connecting link 48 is provided with two generally parallel vertically extending slots 50 and 52. The connecting link may, as shown, be formed of wire in a first generally semi-circular bend 56 to provide a first bight portion 58 extending from the crank 46 to the bend 56 and a second bight 60 parallel the first bight 58 defining therebetween the slot 52. Above the bight 60, the connecting link 48 is further bent at an S bend 62 to define a third bight 64 adjacent and parallel the first bight 58. The bight 64 may be welded or otherwise secured with the first bight 58. Finally, an S bend 66 terminates at a fourth bight 68 generally parallel and spaced apart from the first bight 58 to define the slot 50.

A bracket portion 70 of the machine bed 12 is provided with two apertures 72 and 74 through which project a pair of pivot pins 76 and 78.

The bell cranks 80 and 82 are pivoted, respectively, on the pivot pins 76 and 78 and on respective horizontally extending arms 84 and 86 of the bell cranks 82 and 84 there is provided a pin 88 and 90 extendidng, respectively, through the slots 50 and 52. The other arms 92 and 94 also carry pins 96 and 98 connected to pull rods 102 and 104 connected, respectively, to an operator influenced presser lifter such as a knee shifter or the like and a power operated presser lifting device such as an air cylinder 108. The power operated presser lifting device might, alternatively and without departing from the scope of the present invention comprise, for example, an electric solenoid or other linear actuator.

Figure 2:
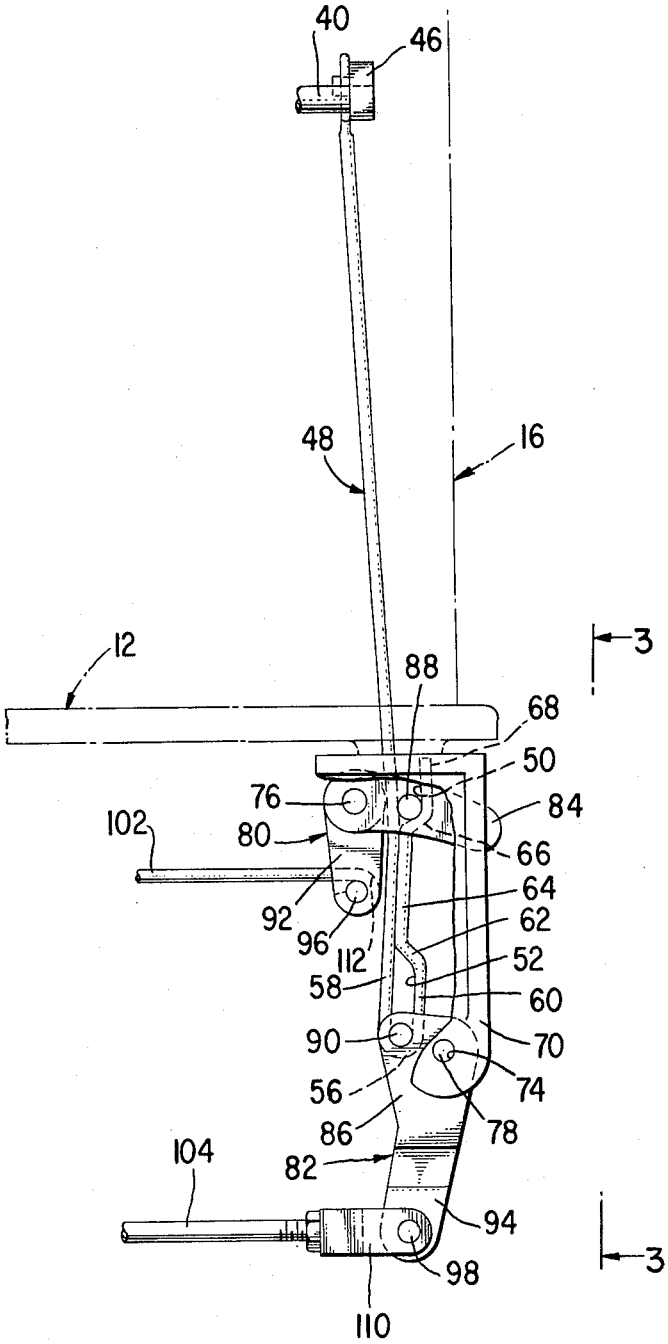
FIG. 2 is an enlarged front elevational view of the linkage arrangement shown in FIG. 1, partially broken away to more clearly illustrate the operation thereof.
Figure 3:
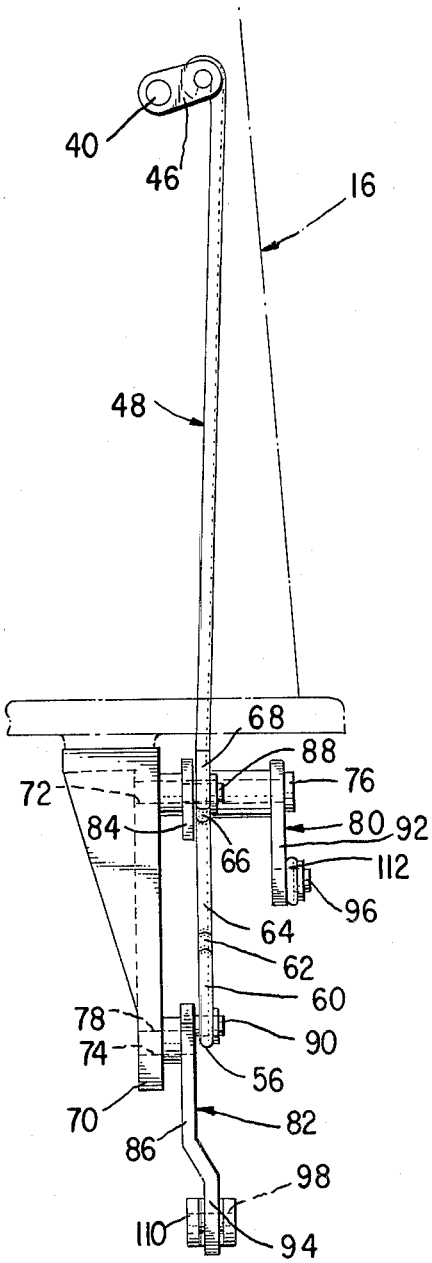
FIG. 3 is an end elevational view of the linkage arrangement shown in FIG. 2, viewed from the right as indicated by line 3—3 on FIG. 2.

With particular reference to FIG. 2, it will be observed that if either of the pull rods 102 or 104 are actuated, that is, if the rod 102 is pulled or moved to the left, or the rod 104 pushed or moved to the right, the associated bell crank will pivot, respectively clockwise or counterclockwise and the respective pin 88 or 90 will, in either event pull down on the link rod 48 while the guide rod slots 50 and 52 enable the link rod to move past the other of the pins 88 and 90 so that such other bell crank will not be effected by the movement of the link rod 48. Accordingly, each of the combinations of slot 50 with pin 88 and slot 52 with pin 90 define lost motion devices such that either the power operated presser lifting device and the operator influenced presser lifter device are connected for independent operation without influence on each other.

In the machine shown, the connecting link 104 is directly connected between the air cylinder 108 and the pin 98, as by a bifrucated end portion 110 embracing the pin 98.

The knee shifter 106, however, in the illustrated embodiment is not directly connected with the rod 102 but, rather, the rod 102 is bent at one end substantially into a circle at 112 embracing the pin 96 and the other end portion of the rod 102 is connected with a lever 114, as by a pin 116 with the lever 114 being pivoted at a medial location on a pin 118 mounted with the machine bed 12. A further right angle lever 120 is mounted with the lever 114 in an end portion thereof opposite the position of the pin 116 and also connected at its lower end portion with the knee shifter 106. Accordingly, rightward pressure on the knee shifter 106 will rotate the lever 114 in a counterclockwise direction around the pivot pin 118 and the pin 116 will apply pull to the rod 102 providing for manual raising of the presser foot 24.

Various changes and modifications may be made without departing from the spirit and scope of the present invention, and it is intended that such obvious changes and modifications be embraced by the annexed claims.

We claim:

1. In a sewing machine, an improved presser lifting arrangement having both a manual direct operator lifting means as well as power actuated lifting means having complete independence of operation as between said manual and said power actuated means, said lifting arrangement comprising lost motion means connected between each of said manual lifting and power actuated lifting means and the presser lifter mechanism.

2. In a sewing machine, an improved presser lifting arrangement having both manual direct operator lifting means as well as power actuated lifting means having complete independence of operation as between said manual and said power actuated means comprising a connecting link between a presser lifting rock shaft of the lifter mechanism in the sewing machine arm and said manual and power operated means, a pair of parallel lost motion slots being formed in a lower portion of said connecting link each embracing a crank pin respectively associated with one of said manual and power actuated means.

3. Sewing machine defined in claim 1 or 2 further comprising a pair of bell cranks for actuating the respective ones of the crank pins within the respective parallel lost motion slots.

4. Sewing machine defined in claim 2 wherein the lower end of said connecting link is formed of wire in a first generally semi-circular bend to provide a first bight portion extending from said rock bar crank to said first bend and a second bight parallel said first bight defining therebetween one of said slots, said wire above said second bight being further bent at an S bend to define a third bight adjacent and parallel said first bight and welded or otherwise secured with said first bight, said wire being yet further bent in a further S bend above said first S bend to terminate at a fourth bight generally parallel and spaced apart from said first bight to define the second of said slots.

5. Sewing machine defined in claim 3 wherein the lower end of said connecting link is formed of wire in a first generally semi-circular bend to provide a first bight portion extending from said rock bar crank to said first bend and a second bight parallel said first bight defining therebetween one of said slots, said wire above said second bight being further bent at an S bend to define a third bight adjacent and parallel said first bight and welded or otherwise secured with said first bight, said wire being yet further bent in a further S bend above said first S bend to terminate at a fourth bight generally parallel and spaced apart from said first bight to define the second of said slots.

6. In a sewing machine having a presser foot lifting arrangement actuated by a presser lifting rock shaft in the sewing machine arm and both a power operated presser lifting actuator such as a pneumatic cylinder, electric solenoid, or other actuator as well as an operator controlled presser lifter actuator such as a knee shift or the like wherein there is provided linkage means for connecting the presser lifting rock shaft in the sewing machine arm with both the operator controlled and the power driven actuators, the improvement wherein the linkage means comprises a link formed with a pair of parallel lost motion slots each embracing a crank pin associated with a respective one of the actuators so that both actuators are connected for independent operation without influence on each other.

* * * * *